United States Patent [19]

Nelson et al.

[11] Patent Number: 4,471,346

[45] Date of Patent: Sep. 11, 1984

[54] SMOKE DETECTOR

[75] Inventors: John E. Nelson, Mountaintop; Alireza Afrashteh, Wilkes-Barre; Umid R. Nejib, Trucksville, all of Pa.

[73] Assignee: Eberhard Faber, Inc., Wilkes-Barre, Pa.

[21] Appl. No.: 269,605

[22] Filed: Jun. 2, 1981

[51] Int. Cl.[3] ..... G08B 17/10

[52] U.S. Cl. ..... 340/628; 179/103; 250/574; 250/381; 340/629; 340/630

[58] Field of Search ..... 340/628, 629, 630; 250/573, 574, 575, 381; 361/212, 224

[56] References Cited

U.S. PATENT DOCUMENTS

| | | | |
|---|---|---|---|
| 2,537,028 | 1/1951 | Cahusac et al. | 340/630 X |
| 3,500,368 | 3/1970 | Abe | 340/629 X |
| 3,710,365 | 1/1973 | Barnes | 340/630 |
| 3,774,186 | 11/1973 | Enemark | 340/630 X |
| 3,846,772 | 11/1974 | Peberdy | 340/630 X |
| 4,030,086 | 6/1977 | Salem | 340/629 X |
| 4,063,227 | 12/1977 | Peterson | 340/630 |
| 4,160,503 | 7/1979 | Ohlbach | 361/212 X |
| 4,223,305 | 9/1980 | Arima | 340/629 |
| 4,302,753 | 11/1981 | Conforti | 340/629 X |

*Primary Examiner*—John W. Caldwell, Sr.
*Assistant Examiner*—Daniel Myer
*Attorney, Agent, or Firm*—LeBlanc, Nolan, Shur & Nies

[57] ABSTRACT

A portable, battery powered smoke detector in which the operative components are compactly and efficiently arranged in such a manner that they may be housed in a pocket-sized casing approximating the shape and size of a cigarette package. A further embodiment shows an efficiently organized arrangement of the smoke detector components in a telephone set.

4 Claims, 13 Drawing Figures

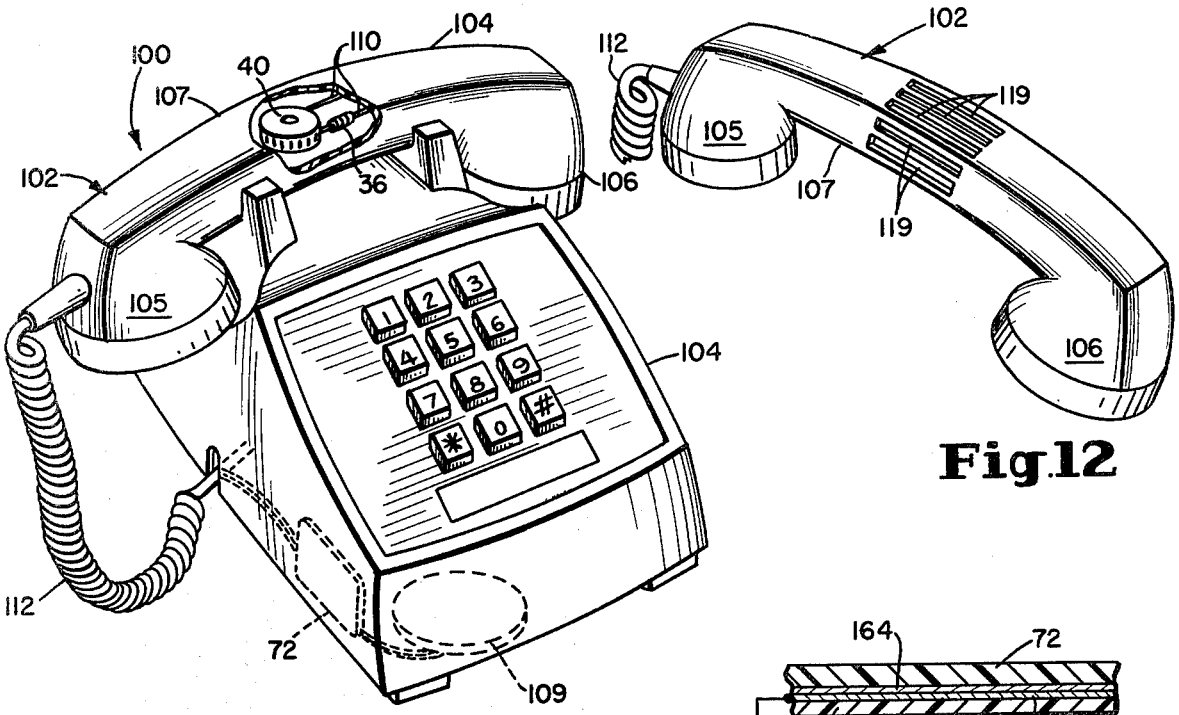
Fig.11
Fig.12
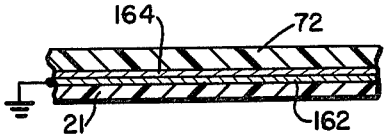
Fig.10
Fig.9
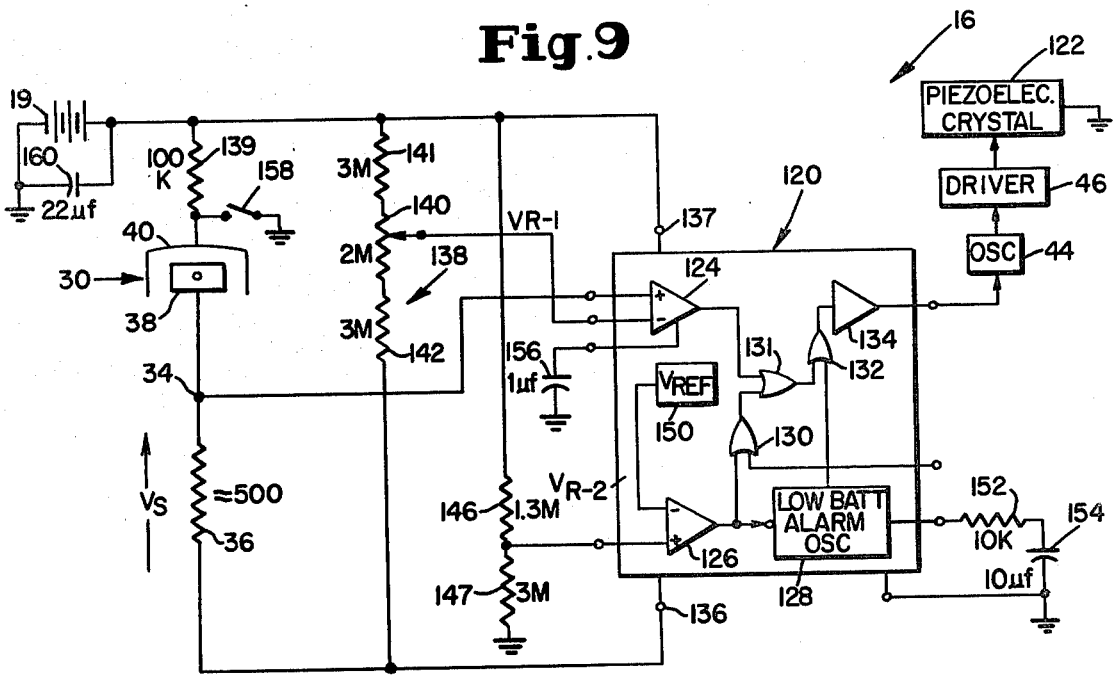

SMOKE DETECTOR

FIELD OF INVENTION

This invention relates to smoke detectors which are capable of sensing gaseous combustion products to provide an early warning of a fire hazard.

BACKGROUND

Prior to this invention, various smoke detectors have been proposed such as the ones described in U.S. Pat. No. 4,004,288 which issued to William Webb Jr. on Jan. 18, 1977, U.S. Pat. No. 3,950,739 which issued to James P. Campman on Apr. 13, 1976, U.S. Pat. No. 3,313,946 which issued to B. G. Goodwin et al on Apr. 11, 1967, U.S. Pat. No. 3,255,441 which issued to B. G. Goodwin et al on June 7, 1966, U.S. Pat. No. 4,119,419 which issued to Anthony Passaro on Oct. 10, 1978, U.S. Pat. No. 3,469,250 which issued to R. H. Voigt on Sept. 23, 1969 and U.S. Pat. No. Des. 238,484 which issued to Roy R. Ludt on Jan. 20, 1976.

Many of the previously proposed smoke detectors are designed for permanent installation on walls or ceilings. These detectors are usually bulky and cannot conveniently be carried by a person from one location to another for temporary use in such places as motel and hotel rooms. A portable type of cordless, battery-powered detector has also been proposed as shown in the above Campman patent. The Campman detector is provided with a flashlight type casing so that it can be carried more easily in a person's pocket. This gas detector, however, is specifically constructed for use while being carried in a person's hand and is not designed in such a manner that it can conveniently be placed for use in rooms on flat furniture surfaces or the like.

SUMMARY AND OBJECTS OF INVENTION

As compared with the detectors described in the foregoing patent, a major aim and purpose of this invention is to provide a novel, battery-powered, pocket-sized smoke detector which is small, portable, compactly organized, and conveniently placeable for temporary use on dressers, tables, nightstands or other flat surfaces. According to one feature of this invention the components of the detector are compactly arranged in a small casing which is in the form and size approximating a cigarette package or other small parellelepiped. Because of this construction, the smoke detector of this invention easily fits into a traveler's garment pocket or briefcase and, additionally, is conveniently placeable for use on flat furniture surfaces in motel or hotel rooms.

According to another novel, space-conserving feature of this invention, certain dimensions of the detector package may further be reduced by positioning the electrical circuitry within the detector's gas-sensing chamber.

Another object of this invention is to provide a smoke detector with a novel low battery alarm circuit which gives an alarm in the event that the battery voltage drops below a pre-selected threshold.

According to yet another feature of this invention, a photoelectric type of smoke detector is equipped with a novel circuit which monitors the photoelectric light source (e.g., a light emitting diode) and which also pulses the light source to conserve battery power.

Yet another object of this invention is to provide a novel, battery powered smoke detector which is economical to manufacture and features low power consumption.

Still another object of this invention is to provide a unique, efficiently organized arrangement of the smoke detector in a telephone set.

A further object of this invention is to provide a novel smoke detector in which the electrical circuit is of a simplified, reliable design having relatively few components.

In the illustrated embodiments, the smoke-sensing device develops a signal voltage which varies in accordance with the quantity of sensed smoke. This signal voltage is applied to a comparator which turns on an alarm oscillator or a buzzer when the signal voltage exceeds a pre-selected value. The battery voltage monitor compares the battery voltage with a fixed reference voltage such that when the battery voltage drops below a pre-selected magnitude, a low frequency oscillator is turned on to pulsate the alarm oscillator.

Further objects will appear as the description proceeds in connection with the appended claims and below-described drawings.

DESCRIPTION OF DRAWINGS

FIG. 9 is a schematic circuit diagram of yet another embodiment of this invention;

FIG. 10 is a section taken substantially along lines 10—10 of FIG. 3;

FIG. 11 is a perspective view of a telephone set incorporating the smoke detector of this invention; and FIG. 12 is a perspective view of the handset shown in FIG. 11.

DETAILED DESCRIPTION

Figure 1:
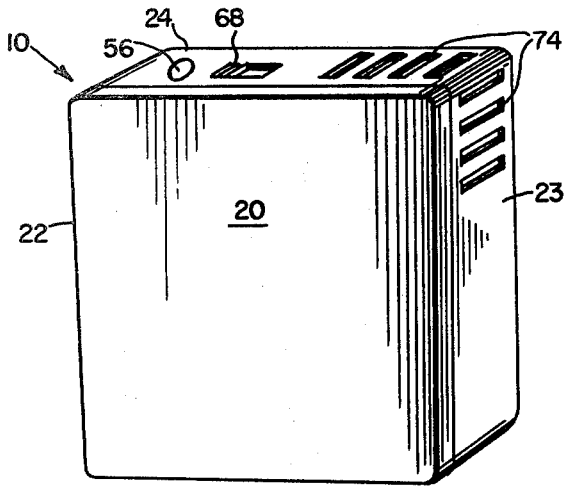
FIG. 1 is a perspective view of a smoke detector incorporating the principles of this invention.
Figure 2A:
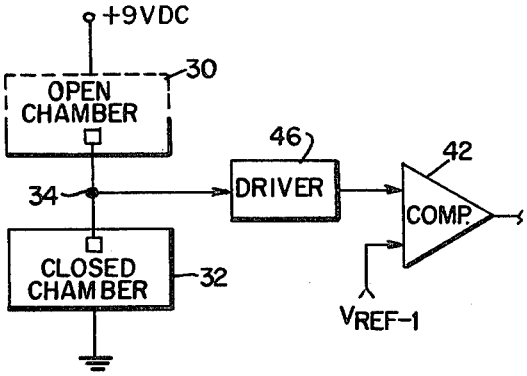
FIG. 2A is a schematic diagram of an alternate form of ionization smoke-sensing device.
Figure 2:
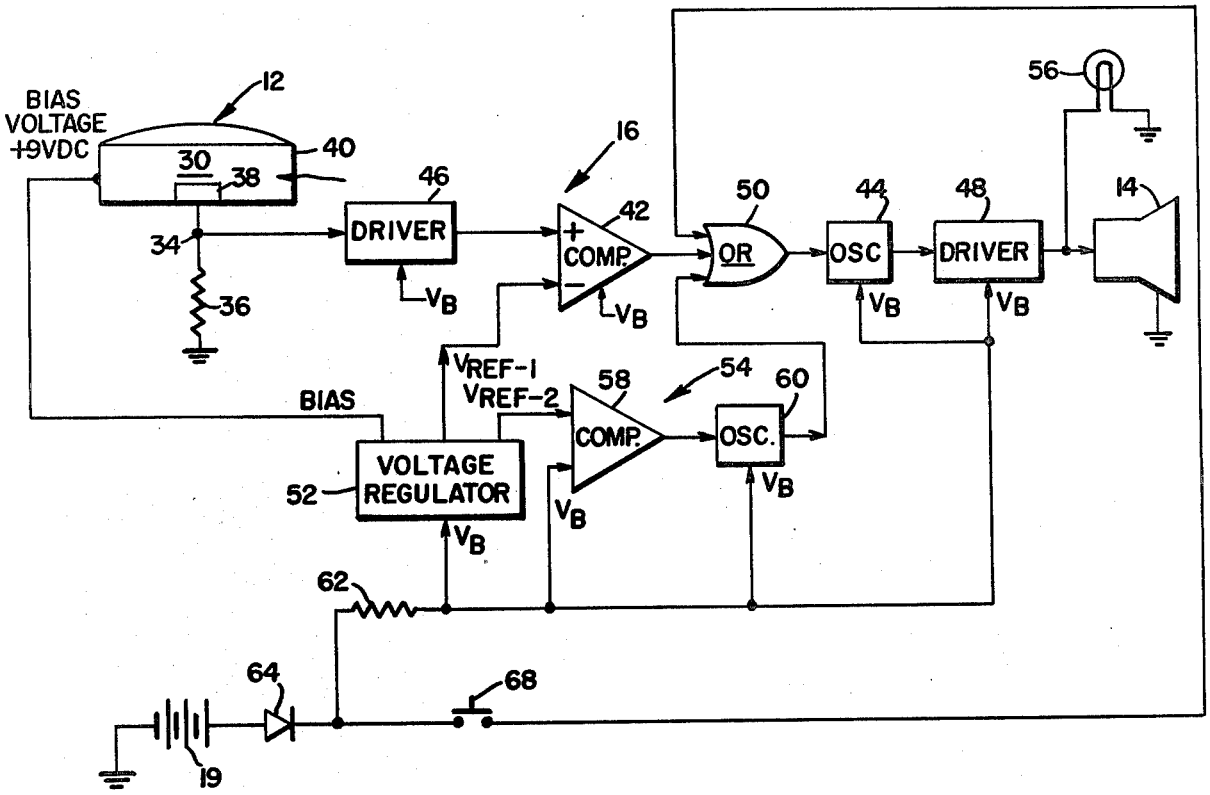
FIG. 2 is a schematic circuit diagram for one embodiment of this invention which utilizes an ionization type of smoke-sensing device.

Referring to the drawings and more particularly to FIGS. 1 and 2, the smoke detector of this invention mainly comprises a hollow casing 10 (see FIG. 1), a smoke-sensing device 12 (FIG. 2), which is preferably capable of sensing the presence of both visible and invisible smoke particles, an alarm device such as a speaker 14 (FIG. 2) and an electrical alarm circuit 16 (FIG. 2) for operating the alarm device in response to detection of smoke by the smoke-sensing device 12. In the embodiment shown in FIG. 2, the smoke-sensing device is an ionization type of sensor, and in the embodiment shown in FIG. 8 the smoke sensing device is a photoelectric sensor 17.

The smoke detector shown in the illustrated embodiments is of the cordless, battery-powered type having a replaceable battery 19 (FIG. 2) which supplies the operating power for the electrical circuit 16 and the smoke sensing device 12. It will be appreciated that an a.c. power source may also be used by rectifying the a.c. power and using the rectified power to trickle charge the power-supply battery. Device 12, circuit 16, speaker 14 and battery 19 are all mounted in casing 10.

Figure 4:
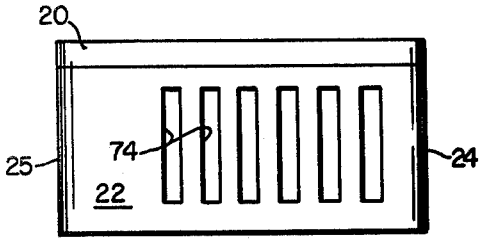
FIG. 4 is a side elevation of the smoke detector shown in FIG. 3.
Figure 5:
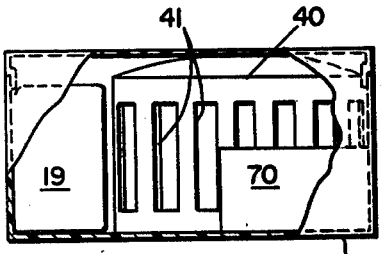
FIG. 5 is a side view similar to FIG. 4, but with the side wall broken away to illustrate interior details.

According to this invention, casing 10 has the configuration and size approximating a cigarette package and is formed with parallel front and back walls 20 and 21 (see FIGS. 1, 3 and 5), parallel side walls 22 and 23 (see FIGS. 1, 4 and 5), and parallel end walls 24 and 25 (see FIGS. 1 and 5). The front wall 20 is advantageously in the form of a detachable, snap-on cover which is removable to provide access to the interior components of the smoke detector. Casing 10 may be formed from a suitable plastics material.

From the foregoing description it will be appreciated that casing 10 is in the form of a rectangularly shaped parallelepiped. For the particular arrangement of components shown in FIG. 3, the exterior dimensions of casing 10 are exceptionally small and may be approximately as follows:

Width (between walls 22 and 23): 2 9/16 inches (65 mm)
Height (between walls 24 and 25): 2 7/16 inches (62 mm)
Depth (between walls 20 and 21): 1 3/16 inches (30 mm)

For the arrangement of components shown in FIG. 6 the exterior dimensions of casing 10 are also relatively small, one example being as follows:

Width (between walls 22 and 23): 78 mm
Height (between walls 24 and 25): 70 mm
Depth (between walls 20 and 21): 19 mm The foregoing dimensional examples are indicative of a pocket-sized smoke detector. The width and height of casing 10 are the major dimensions of the casing and are measured perpendicular to each other in a common plane, and the depth is measured normal to the aforesaid common plane.

From the foregoing description it is apparent that the portable, pocket-sized smoke detector of this invention is easily carried in a garment pocket (such as a coat pocket), a pocketbook, or briefcase. Because of the casing's configuration, the smoke detector of this invention may be placed on flat furniture surfaces in various different positions. Thus, the smoke detector of this invention may conveniently be carried from place to place by a traveler for use in motel or hotel rooms. A thin permanent magnet (not shown) in the form of a strip may be exteriorally secured to one of the casing walls, thus enabling the smoke detector to be removably attached to a metallic surface.

The ionization smoke sensing device 12 may be of one of two conventional types. A single-chamber type is shown in FIG. 2, and a dual-chamber type is shown in FIG. 2A.

With reference to FIG. 2A, the ionization smoke-detecting device typically comprises an open chamber 30 and a closed chamber 32. The chamber construction is such that air and any smoke particles in the ambient surroundings can enter chamber 30 but not chamber 32. Chambers 30 and 32 are electrically interconnected at a junction 34. A d.c. bias voltage is applied to chamber 30 and the closed chamber is grounded as shown. The closed chamber 32 is used as a reference chamber, and the open chamber 30 is used as an active chamber to sense the presence of smoke. The output signal voltage at junction 34 is indicative of the presence or absence of smoke and also the quantity of smoke. Reference is made to the previously identified U.S. Pat. No. 4,004,288 for this type of ionization smoke-sensing unit. It will be appreciated that the dual ionization chamber unit operates as a voltage divider.

In the ionization smoke-sensing device shown in FIG. 2 the closed chamber is replaced by a large resistor 36. Resistor 36 and the open chamber's radioactive, alpha particle source 38 are electrically interconnected at junction 34. The open chamber 30 is defined by a dome 40, the peripheral side wall of which is formed with apertures 41 (FIG. 5). The alpha particle source 38 is located within chamber 30 and may be of any suitable material such as Americium or Radium 226. Like the dual chamber embodiment, chamber 30 operates as a variable resistor whose electrical resistance to current flow varies as a function of the quantity of sensed smoke particles entering dome 40. When no smoke particles are introduced into chamber 30, the voltage across resistor 36 will be at a relatively high, stable value. Smoke entering chamber 30 increases the open chamber's electrical resistance, thus decreasing the voltage across resistor 36.

As shown in FIG. 2, circuit 16 comprises a comparator 42, an oscillator 44, drivers 46 and 48, a logic OR gate 50, a voltage regulator 52, and a battery voltage monitor 54. The variable alarm signal voltage at junction 34 is applied by driver 46 to one input of comparator 42. Comparator 42 compares the smoke sensor's alarm signal with a fixed reference voltage $V_{Ref\text{-}1}$. The fixed reference voltage $V_{Ref\text{-}1}$ is supplied by voltage regulator 52 and is set at a pre-selected value such that when no smoke particles of any significant amount are present within chamber 30, the output of comparator 42 will be low to zero volts. However, when a sufficient quantity of smoke particles are present in chamber 30 to indicate a fire hazard, the voltage across resistor 36 falls sufficiently to cause the voltage at the output of comparator 42 to rise to a pre-selected level.

The output of comparator 42 is fed through OR gate 50 to oscillator 44 such that when the output voltage of comparator 42 goes high to indicate a fire hazard, oscillator 44 will be turned on to drive speaker 14 through driver 48. In the quiescent state when no fire hazard is sensed, oscillator 44 will be turned off, and speaker 14 will therefore be inoperative.

If desired, a lamp 56 may be connected in parallel with speaker 14 so that a visual alarm, as well as an audible alarm, is supplied upon sensing a fire hazard.

With continued reference to FIG. 2, the battery voltage monitor 54 comprises a comparator 58 and a low frequency oscillator 60. The battery voltage $V_B$ developed by the drop across a resistor 62 is applied to one input of comparator 58 for comparison with a fixed reference voltage $V_{Ref\text{-}2}$ which is supplied by the voltage regulator 52. The output of comparator 58 is connected to drive oscillator 60. The fixed reference voltage $V_{Ref\text{-}2}$ is preselected such that when the battery voltage $V_B$ is above the predetermined value which is sufficient to power the electrical equipment, the output of comparator 58 will be at zero volts. Under this condition, oscillator 60 will be turned off.

However, when the battery voltage $V_B$ drops below the pre-selected reference voltage $V_{Ref\text{-}2}$, the output of comparator 58 rises to a pre-selected magnitude which turns on oscillator 60. The reference voltage is set high enough so that when the battery voltage $V_B$ begins to drop just below the fixed reference voltage, there is still sufficient battery power to operate circuit 16.

The output frequency of oscillator 60 is applied to logic gate 50 such that the oscillations of oscillator 60 are applied through gate 50 to oscillator 44. Oscillator 60 preferably generates a d.c. square wave in which positive going pulses energize oscillator 44. Oscillator 44 will therefore be intermittently energized by oscillator 60 whenever the latter is turned on. The pulse operating frequency of oscillator 60 is selected to be substantially less than the operating frequency of oscillator 44 so that oscillator 44 will produce a multitude of cycles for each pulse at the output of oscillator 60. For example, the operating frequency of oscillator 44 may be 3000 Hz, and the operating frequency of oscillator 60 may be 1/30 Hz, with a pulse width of about 10 milliseconds. As a result, speaker 14 will emit an intermittent tone to distinguish the low battery voltage alarm from the continuous tone used for signalling a fire hazard. From the foregoing description it is clear that the battery voltage is continuously monitored by comparator 58 and that an intermittent alarm is produced if the battery voltage drops below a pre-selected value. The long duty cycle of 30 seconds for the low battery voltage alarm conserves power and ensures that the alarm will be produced intermittently over a long time period.

Regulator 52 may be of any suitable, conventional circuit design, and it may have a resistive voltage divider (not shown) at its output for developing the reference voltages $V_{Ref\text{-}1}$ and $V_{Ref\text{-}2}$ as well as the bias voltage for the ionization smoke-sensing device 12. Regulator 52 may also be equipped with a potentiometer (not shown) for selectively adjusting the reference voltage $V_{Ref\text{-}1}$ to thus provide for the selective adjustment of the sensitivity of the smoke detector. A buzzer 70 (see FIG. 3) may be used in place of oscillator 44, driver 48 and speaker 14.

The current conducted through chamber 30 is kept at a very low value by the high impedance of driver 46, thereby ensuring a long battery life. If comparator 42 is provided with a high input resistance, then driver 46 may be eliminated.

A diode 64 connected between battery 19 and resistor 62 blocks current flow in the event that battery 19 is inserted into the smoke detector in reverse. The smoke detector may also be equipped with a test circuit which comprises a manual test switch 68. Closure of switch 68 completes a circuit between battery 19 and gate 50, thus turning on oscillator 44 to drive speaker 14 through driver 48. In the event that battery 19 is inserted into the smoke detector in reverse to reverse bias diode 64, closure of switch 68 will not produce the audio or visual signal.

Figure 3:
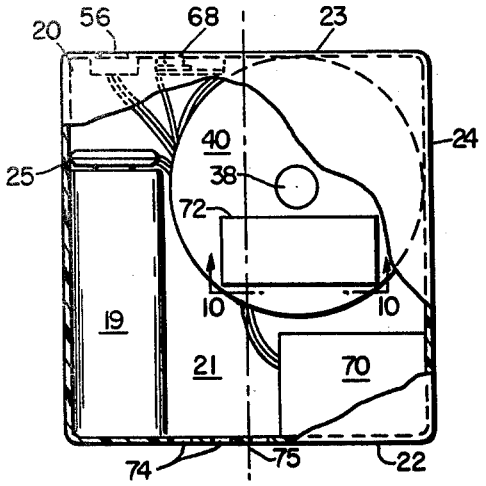
FIG. 3 is a plan view of the smoke detector with the casing partially broken away to show one compact, efficiently organized arrangement of component parts.

Referring to FIGS. 3 and 5, the chamber-defining dome 40 is located as near as possible to the corner defined by walls 23 and 24, and the buzzer 70 (or speaker 14) is located at the adjacent corner which is defined by walls 22 and 24. Both dome 40 and buzzer 70 lie immediately adjacent to wall 24. Battery 19 is located immediately adjacent to and extends along wall 25. The complete electrical circuit except for resistor 36 is mounted on a suitable circuit card or board 72 which advantageously is mounted underneath dome 40 within the ionization chamber 30.

With the foregoing arrangement it will be appreciated that, as viewed from FIG. 3, battery 19 is located laterally to the left of a plane 75 medially intersecting casing 10 and extending perpendicularly of cover 20 and wall 21. Buzzer 70 (or speaker 14, if it is used) and the central axis of dome 40 are located laterally to the right of the medial plane 75. The battery's longitudinal axis and the dome's central axis (which intersects the centrally located radioactive source 38) are parallel to the plane 75 and extend perpendicularly with respect to one another on opposite sides of plane 75. Battery 19 and the subassembly of dome 40 and buzzer 70 (or speaker 14) lie in side-by-side relation to each other as shown in FIG. 3.

Walls 22, 23 and 24 are formed with apertures 74 (see FIGS. 1, 3 and 4) to provide for the free flow of air and any smoke particles into and through chamber 30.

Figure 6:
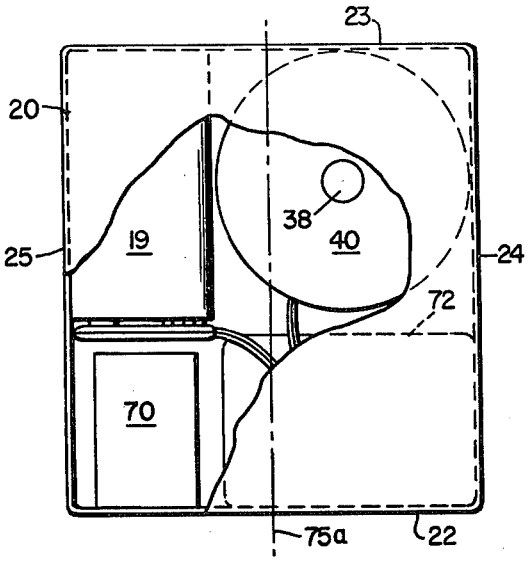
FIG. 6 is a top plan view similar to FIG. 3, but showing an alternate arrangement of componentry within the detector's casing.
Figure 7:
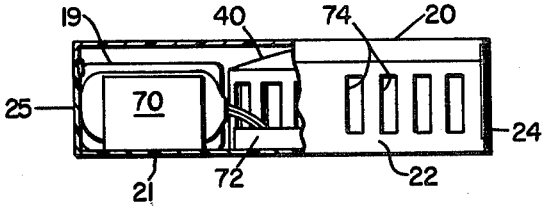
FIG. 7 is a side view of the detector shown in FIG. 6 and having the side wall partially broken away to illustrate interior details.

In the arrangement shown in FIGS. 6 and 7, the electrical circuit card 72 is located exteriorally of chamber 30 in the corner defined by walls 22 and 24, and buzzer 70 (or speaker 14) is located at the corner defined by walls 22 and 25. Battery 19 is located along wall 25 between buzzer 70 and wall 23. For the arrangement of components shown in FIG. 6, battery 19 and buzzer 70 are located laterally to the left of a plane 75*a* medially intersecting casing 10 and extending perpendicularly with respect to cover 20 and wall 21, while the central axis of dome 40 and the center of circuit card 72 are laterally to the right of plane 75*a*.

Figure 8:
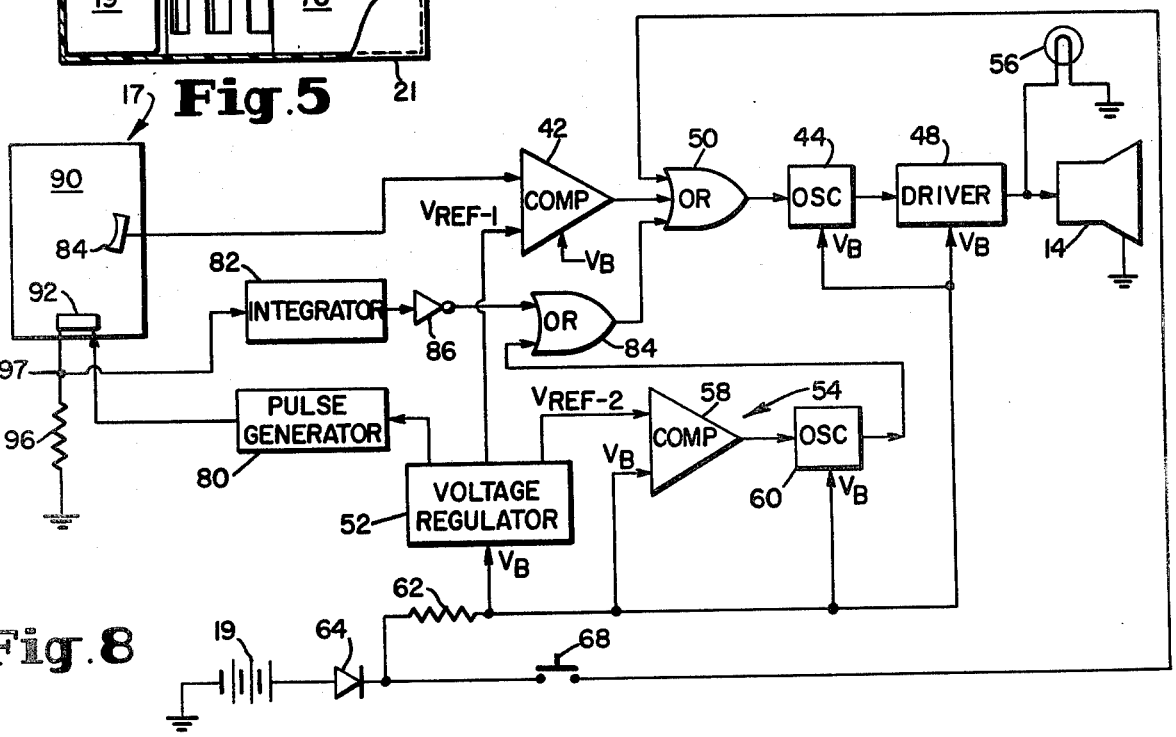
FIG. 8 is an electrical circuit diagram of yet another embodiment of this invention incorporating a photoelectric type of smoke-sensing device.

The circuit shown in FIG. 8 is the same as that in FIG. 2 with the exception of the substitution of the photoelectric smoke sensor 17 for the ionization sensor 12, the elimination of driver 46, and the addition of a pulse generator 80, an integrator 82, a logic OR gate 84 and an inverter 86. Like reference numerals have been used to designate like parts in FIGS. 2 and 8.

The photoelectric smoke sensor 17 is provided with a smoke-sensing chamber 90 which contains a light-emitting diode 92 or other suitable light source and a suitable photodetector 94 (also referred to as a photoconductive cell) such as a photoelectric cell, a semiconductor photodiode, a phototransistor or a phototube. The photoelectric chamber 90 may be defined by any suitable apertured enclosure such as the dome 40 to allow air and smoke particles to flow through the photoelectric chamber.

The photoelectric smoke-sensing device 17 operates on the principle of forward scattering of light which occurs when smoke particles enter chamber 90. The presence of smoke particles in chamber 90 will increase the forward scattering of light. This is sensed by photodetector 94 to increase the photodetector's output voltage. The photodetector's output voltage is applied to comparator 42 which compares it with the fixed reference voltage $V_{Ref\text{-}1}$. As the quantity of smoke particles within chamber 90 increases, the output voltage of photodetector 94 increases, and when the detector's output voltage exceeds the reference voltage $V_{Ref\text{-}1}$, the voltage at the output of comparator 42 rises from zero to a pre-selected value. The comparator's output 42, upon rising to this pre-selected value, will turn on oscillator 44 as previously explained. When oscillator 44 is turned on, speaker 14 will be energized through driver 48 as previously described.

Pulse generator 80 is energized by a voltage from regulator 52 to generate a train of time spaced pulses at a constant pre-selected pulse repetition frequency. The pulses generated by generator 80 are conducted serially through the light emitting diode 92 and a resistor 96 to ground. Diode 92 is therefore intermittently illuminated. For example, diode 92 may be on for 10 milliseconds and off for 100 milliseconds. By pulsing diode 92, the average battery current drawn by the light emitting diode is considerably reduced to conserve battery power.

In order to give a warning signal in the event that the light emitting diode 92 burns out, the voltage across resistor 96, which is in series with diode 92, is continuously monitored. This is accomplished by connecting the junction 97 between resistor 96 and diode 92 to the input of integrator 82. The output of integrator 82 is connected through inverter 86 to an input of gate 84, and the output of gate 84 is connected to one of the inputs of gate 50.

When diode 92 is conducting the pulses from generator 80, a corresponding pulsating d.c. voltage will be developed at junction 97. Integrator 82 may be of any suitable, conventional circuit design for smoothing the pulsating d.c. voltage to produce a continuous d.c. output voltage representing a logic 1. The logic output of integrator 82 is inverted by inverter 86 and applied to OR gate 84. The output of inverter 86 will therefore be zero as long as diode 92 is conducting the pulses from generator 80. Under this condition, the outputs of gates 84 and 50 will remain low at zero volts, provided that oscillator 60 is off and the output of comparator 42 is low at zero volts.

If diode 92 burns out, the circuit between resistor 96 and generator 80 will open, causing the voltage at junction 97 to drop to and remain at zero. As a result, the output of integrator 82 will drop to zero volts (representing a logic 0), causing the output of inverter 86 to go high to a pre-selected voltage representing a logic 1. The logic 1 voltage at the output of inverter 86 is conducted through gates 84 and 50 to turn on oscillator 44, thus energizing speaker 14 to give a warning signal in response to the failure of diode 92. Because integrator 82 produces a continuous d.c. output voltage as long as diode 92 is being pulsed, the possibility of a false alarm during the interval between pulses is negated.

In the embodiment shown in FIG. 8, the output of oscillator 60 is applied to the input side of gate 84. When oscillator 60 is turned on to indicate low battery voltage, the d.c. pulses supplied by oscillator 60 are conducted through gates 84 and 50 to pulsate oscillator 44, thus causing the intermittent energization of speaker 14.

To the extent that the embodiments of FIGS. 2 and 9 are the same, like reference numerals have been applied to designate like parts. In FIG. 9, circuit 16 has been modified to incorporate an integrated circuit chip 120, and speaker 14 has been replaced with a piezoelectric crystal 122.

As shown in FIG. 9, the integrated circuit 120 may be of a conventional design such as the National Semiconductor LM1801 or the Siliconix SM110. Circuit 120 includes a pair of comparators 124 and 126 (corresponding to comparators 42 and 58, respectively), a low battery alarm oscillator 128 (corresponding to oscillator 60), a set of logic gates 130, 131 and 132 and a signal amplifier 134.

Still referring to FIG. 9, the open ionization chamber 30 and resistor 36 are connected in series between battery 19 and the bias voltage pin 136 in circuit 120. Circuit 120 also has a battery voltage pin 137 which is connected to battery 19 in the manner shown. Pins 136 and 137 are connected to the components, in circuit 120 to supply operating power thereto.

In the embodiment of FIG. 9, a small resistor 139 (e.g., 100k ohms) is connected between battery 19 and the open chamber 30 in series with chamber 30 and resistor 36. The junction 34 between chamber 30 and resistor 36 is connected to the positive input of comparator 124 for comparison with a reference voltage $V_{R\text{-}1}$. Reference voltage $V_{R\text{-}1}$ is developed by a resistive voltage divider 138 having an adjustable resistor 140 connected in series between a pair of large fixed resistors 141 and 142. Divider 138 is connected between battery 19 and pin 136. The adjusting arm of resistor 140 is connected to the negative input of comparator 124 so that selective adjustment of resistor 140 sets the desired sensitivity level of the smoke detector.

From the foregoing description it will be appreciated that when smoke particles enter chamber 30 to decrease the current flowing through the chamber, the voltage $V_s$ across resistor 36 decreases. When a sufficient quantity of smoke particles enters chamber 30, the voltage across resistor 36 will fall below the reference voltage $V_{R\text{-}1}$. When this condition occurs, the output of comparator 124 changes state to supply an alarm signal through gates 131 and 132 to drive the output of amplifier 134 high to a pre-selected voltage. This amplifier output energizes oscillator 44 which, in turn, energizes the piezoelectric crystal 122 to sound the alarm.

In order to monitor the battery voltage, a further voltage divider having a pair of series connected resistors 146 and 147 is connected across battery 19. The junction between resistors 146 and 147 is connected to one input of comparator 126 such that the voltage dropped across resistor 147 is compared with a further reference voltage $V_{R\text{-}2}$ which is developed by a reference voltage source 150 in circuit 120. When the voltage across resistor 147 drops below the reference voltage $V_{R\text{-}2}$, oscillator 128 is energized, and the output of oscillator 128 is supplied through gate 132 to drive amplifier 134 and thus energize oscillator 44. The output of oscillator 128 is a pulsating voltage having a pulse repetition frequency which may be the same or approximately the same as that of oscillator 60 in the embodiment of FIG. 2. Thus, when oscillator 128 is turned on to signal a low battery voltage condition, the output of amplifier 134 will be pulsated. The pulsating output of amplifier 134 in turn pulsates oscillator 44 in the manner previously described for the embodiment of FIG. 2. This pulsating output of oscillator 44 thus provides a pulsating drive for the piezoelectric crystal 122 to generate an intermittent audible alarm for signalling low battery voltage. The interval between pulses supplied by oscillator 128 is set by a timing circuit comprising a resistor 152 and a capacitor 154 which are connected between oscillator 128 and ground in the manner shown. A capacitor 156 may be connected in the manner shown and acts as a low pass filter to ground noise signals.

Still referring to FIG. 9, a test switch 158 is connected between ground and the junction between dome 40 and resistor 139. Closure of test switch 158 applies ground potential to the junction between dome 40 and resistor 139, whereby battery current is conducted directly to ground to bypass the open ionization chamber 30 and resistor 36. Thus, closure of test switch 158 decreases voltage $V_s$ to simulate a smoke condition which energizes oscillator 44 through the integrating circuit 120 to activate the piezoelectric alarm crystal 122. If a buzzer is used in place of the piezoelectric alarm crystal, a capacitor 160 may be connected directly across battery 19 to provide sufficient starting current for the buzzer in the event of a low battery voltage alarm condition.

The outer casing for the circuit design shown in FIGS. 8 and 9 is the same as that shown in FIGS. 1 and 3–5. Either one of the circuits shown in FIGS. 8 and 9 is mountable on the circuit board 72 (FIGS. 3 and 6) in place of the circuit shown in FIG. 2.

As a result of handling the portable smoke detector, an electrostatic charge may develop on the smoke detector casing to cause a false alarm to be given by the smoke detector circuit. To minimize the build-up of such an electrostatic charge, an electrically conductive pad or layer 162 and an electrically nonconductive sheet or layer 164 may be arranged between the circuit board 72 and the underlying wall 21 of the plastic casing in the manner shown in FIG. 10. The electrically conductive pad 162 lies flat against the casing wall 21 and is connected to ground. The electrically non-conductive sheet or layer 164 is sandwiched between the circuit board 72 and the electrically conductive pad 162 to insulate the former from the latter. Pad 162 is fixed to the casing wall 21 by glue or other suitable means. The electrically non-conductive layer or sheet 164 is fixed to pad 162 and circuit board 72 by glue or other suitable means. The electrically conductive pad 162 may be formed from any suitable material such as aluminum foil. The electrically non-conductive layer may also be formed from any suitable material such as paper.

In FIGS. 11 and 12, the smoke detector of this invention in incorporated into a conventional, two-piece telephone set 100 having a handset 102 and a dial and switching housing 104. Handset 102 typically comprises a split-hollow plastic casing 104 having a transmitter portion 105 for receiving the telephone's transmitter, a receiver portion 106 for receiving the telephone's receiver, and a handle portion 107 extending between and interconnecting the portions 105 and 106. Housing 104 receives the usual telephone equipment, including the telephone ringer 109 (FIG. 11). Any one of the circuit designs shown in FIGS. 2, 8 and 9 may be utilized in the embodiment shown in FIGS. 11 and 12.

As shown in FIG. 11, the apertured dome 40 is mounted within the hollow handle portion 107 of casing 102. Dome 40 may be of any suitable configuration to fit within the available free space within handle portion 107.

The electrical circuit 16 is mounted on the circuit card 72 as previously described, and circuit card 72 is suitably mounted within housing 104. The conductors connecting the chamber-defining dome 40 and resistor 36 to the electrical circuit 16 are indicated at 110 and may extend within the insulating covering of the telephone cord 112 which interconnects handset 102 with the equipment in housing 104.

The telephone ringer 109 may advantageously be connected to the electrical circuit 16 in place of speaker 14 or crystal 122. With such an arrangement, it is understood that when oscillator 44 is turned on, it will operate the telephone ringer 109 to thus give a warning signal of a fire hazard. For the embodiment shown in FIGS. 11 and 12, battery 19 may be eliminated and the electrical circuit 16 and the smoke-sensing ionization device 12 may be powered by the telephone company's central office battery which feeds direct current over the telephone line to the telephone set at the subscriber's station. Additionally, equipment (not shown) can be adapted to respond to the warning signal generated by oscillator 44 to complete a circuit for automatically transmitting an emergency message to a central station for alerting the central station that a fire hazard exists at the subscriber's premises.

The handle portion 107 of handset 102 is formed with apertures 119 (see FIG. 11) along its top wall and both side walls (only one shown in FIG. 11) to provide for the flow of air and any smoke into the interior of handle portion 107 and through open ionization chamber 30 which is defined by dome 40.

Because of its small size, the smoke detector of this invention may also be incorporated into other equipment such as a radio, a clock, a clock-radio or a television set.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A cordless, battery-powered, smoke detector comprising first means for detecting the presence of smoke, second means electrically connected to said first means for producing an alarm in response to the detection of smoke by said first means, batter means for supplying electrical power to said first and second means, and a hollow casing enclosing said first and second means and said battery means, the configuration of said casing being parallelepiped, said first means comprising a photoelectric smoke-sensing device having an electrically energizable light-emitting diode and a photodetector cooperating with said light-emitting diode for developing an electrical signal whose magnitude varies as a function of the light received from said light-emitting diode, said second means comprising (a) an alarm-indicating device and (b) an electrical circuit connected to said photodetector and said alarm-indicating device for activating said device to give an alarm whenever said electrical signal varies in a certain direction from a preselected value, and means forming a part of said circuit and electrically connected to said light-emitting diode for monitoring the flow of current through said diode and for activating said alarm-indicating device to give an alarm in response to current-interrupting burn-out of said light-emitting diode.

2. A cordless, battery-powered, smoke detector comprising first means for detecting the presence of smoke, second means electrically connected to said first means for producing an alarm in response to the detection of smoke by said first means, battery means for supplying electrical power to said first and second means, and a hollow casing enclosing said first and second means and said battery means, the configuration of said casing being a parallelepiped, said first means comprising a photoelectric smoke-sensing device having (a) an apertured enclosure defining a smoke-sensing chamber for receiving air and any smoke in the air, (b) an electrically energizable light-emitting device disposed in said chamber, and (c) a photodetector disposed in said chamber for developing a signal voltage which varies as a function of the light received from said light-emitting device, said second means comprising (a) an alarm-indicating device and (b) an electrical circuit connected to said photodetector and said alarm-indicating device and having (i) means for activating said alarm-indicating device to give an alarm whenever said signal voltage varies in a certain direction from a preselected value, (ii) means for conducting pulses of electrical current through said light-emitting device to intermittently energize said light-emitting device and (iii) means electrically connected to said light-emitting device for monitoring the flow of current through said light-emitting device, said monitoring means being responsive to a current interrupting burn-out of said light-emitting device to activate said alarm-indicating device.

3. The portable, cordless, battery-powered, pocket-sized smoke detector defined in claim 2 wherein said monitoring means comprises an integrator connected to said circuit for integrating voltage pulses which are developed by the conduction of the current pulses through said light-emitting device to produce a continuous signal voltage of predetermined magnitude as long as said light-emitting device conducts said current pulses, and means connected intermediate said integrator and said alarm-indicating device and responsive to the absence of said continuous signal voltage for energizing said alarm-indicating device to give an alarm signal.

4. A battery-powered smoke detector comprising a photoelectric smoke-sensing device having an electrically energizable light-emitting device and a photodetector cooperating with said light-emitting device for producing a first signal in response to the presence of smoke, an electrical circuit, battery means for supplying power to said circuit, said electrical circuit comprising means responsive to said first signal for producing a second signal, means electrically connected to said light-emitting device for conducting time-spaced pulses of electrical current through said light-emitting device to intermittently energize said light-emitting device, further means connected by electrical conductor means to said light-emitting device for developing a pulsating signal voltage as long as said electrical current pulses are conducted through said light-emitting device, integrator means electrically connected to said further means for producing a continuous d.c. signal in response to said pulsating d.c. voltage, means electrically connected to said integrator means for producing a third signal in response to the absence of said continuous d.c. signal, and means responsive to the occurrence of said second signal for producing an audible alarm, said alarm-producing means further being responsive to the occurrence of said third signal for producing said alarm.

* * * * *

UNITED STATES PATENT AND TRADEMARK OFFICE

CERTIFICATE OF CORRECTION

PATENT NO. : 4,471,346

DATED : September 11, 1984

INVENTOR(S) : Nelson et al

It is certified that error appears in the above-identified patent and that said Letters Patent is hereby corrected as shown below:

Column 10, line 32, change "batter" to --battery--.

Column 11, line 9, change "device" to --diode--.

Signed and Sealed this

*Second* Day of *July 1985*

[SEAL]

*Attest:*

DONALD J. QUIGG

*Attesting Officer* *Acting Commissioner of Patents and Trademarks*